United States Patent [19]

von Berckheim

[11] 3,950,153

[45] Apr. 13, 1976

[54] ELECTROSTATIC PRECIPITATOR

[76] Inventor: Constantin Graf von Berckheim, Friedrichstrasse 9, 6940 Weinheim an der Bergstrasse, Germany

[22] Filed: Dec. 10, 1973

[21] Appl. No.: 430,301

[30] Foreign Application Priority Data

Dec. 11, 1972 Germany ..... 2260550

[52] U.S. Cl. ..... 55/138; 55/155

[51] Int. Cl.[2] ..... B03C 3/08

[58] Field of Search ..... 55/138, 136, 140–157, 55/440, 446, 154, 155

[56] References Cited

UNITED STATES PATENTS

| | | | |
|---|---|---|---|
| 1,035,422 | 8/1912 | Cottrell et al. | 55/148 |
| 2,885,026 | 5/1959 | Di Vette | 55/142 |
| 3,248,857 | 5/1966 | Weindel et al. | 55/155 |
| 3,362,135 | 1/1968 | Steuernagel et al. | 55/154 |
| 3,435,594 | 4/1969 | Steuernagel | 55/140 |
| 3,482,375 | 12/1969 | Ellingen | 55/151 |
| 3,623,828 | 11/1971 | Shapiro | 55/446 |
| 3,765,154 | 10/1973 | Hardt et al. | 55/148 |

FOREIGN PATENTS OR APPLICATIONS

| | | | |
|---|---|---|---|
| 713,692 | 8/1931 | France | 55/154 |
| 204,361 | 9/1923 | United Kingdom | 55/138 |
| 966,558 | 8/1964 | United Kingdom | 55/154 |

*Primary Examiner*—Bernard Nozick
*Attorney, Agent, or Firm*—Michael S. Striker

[57] ABSTRACT

An electrostatic precipitator has spaced electrodes at least one of which is a collector electrode to which charged particles are attracted. The collector electrode is provided with a plurality of projections which enhance its ability to attract and retain charged particles.

18 Claims, 4 Drawing Figures

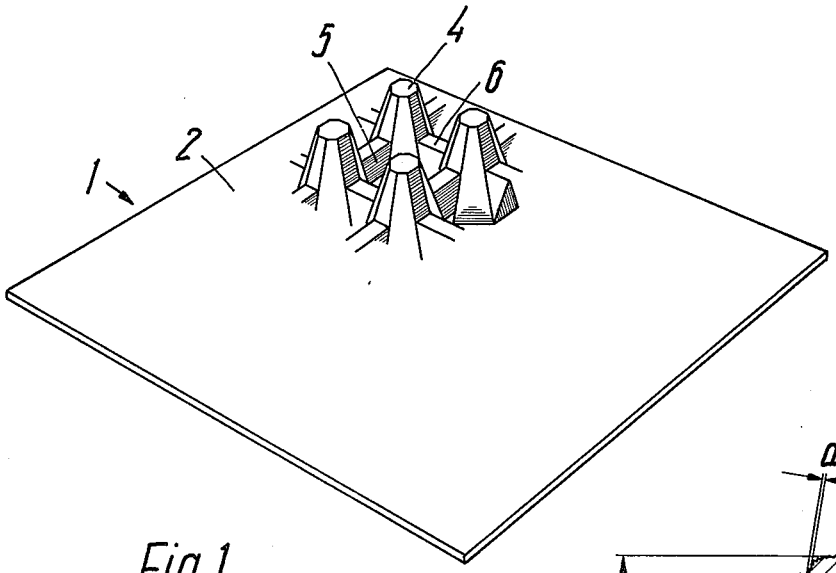
Fig. 1
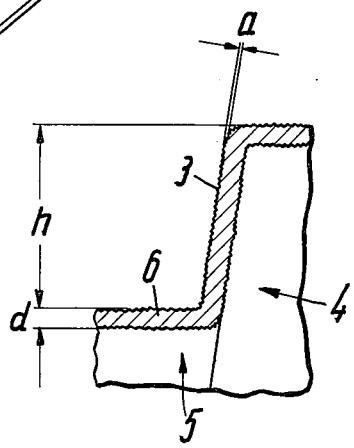
Fig. 2
Fig. 3
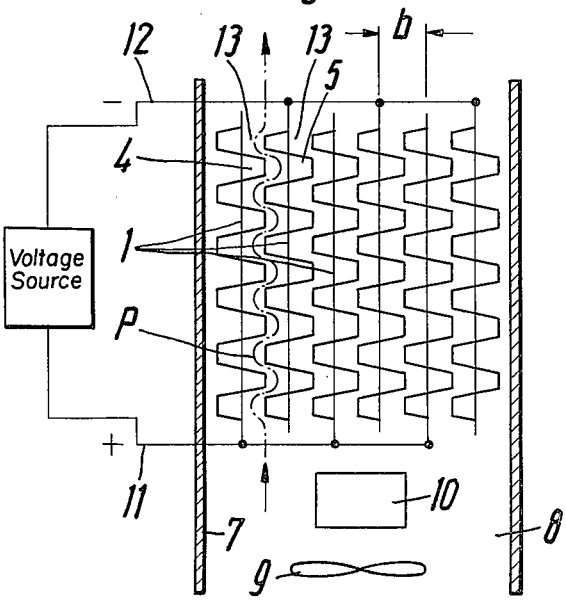
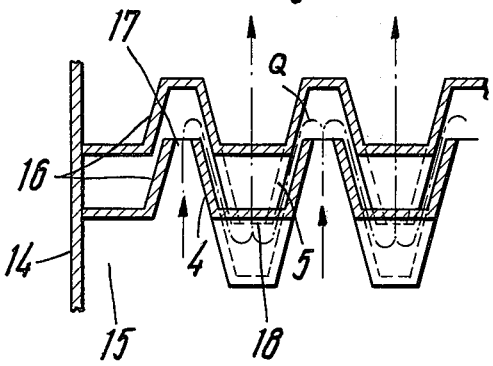
Fig. 4

ELECTROSTATIC PRECIPITATOR

BACKGROUND OF THE INVENTION

The invention relates generally to device wherein charged particles are attracted to and deposited on one or more electrodes. More particularly, the invention relates to electrofilters or electrostatic precipitators. Of special interest are the electrodes used in such devices.

In electrostatic precipitators, a path is provided for the passage of a gas such as air. Collector electrodes, that is, electrodes to which charged particles are attracted and on which they deposit, are located in this path or immediately adjacent thereto so as to bound the same. An electrostatic field is set up between a collector electrode and a counterelectrode or discharge electrode, and the influence of this field causes ionized impurity particles to be attracted to the collector electrode so that they are separated from the other particles of the gas. Normally, the counterelectrode or discharge electrode also defines a collector electrode and the particular collector electrode to which the ionized impurity particles are attracted will depend upon the sign of the charge carried by the impurity particles. If necessary, an ionization region may be provided upstream of the region where separation of the impurity particles occurs.

Since, by virtue of their function, the collector electrodes become rapidly contaminated, care has heretofore been taken to insure that they could be easily cleaned. The collector electrodes were thus made of metal and provided with smooth surfaces and were installed in such a manner that they were easily accessible. Moreover, in order to avoid the cleaning operation entirely, it has also become known to replace these metal electrodes with readily exchangeable disposable elements which are composed of an inexpensive material such as metallized cardboard, conductive synthetic resin or the like. Insofar as the form and surface characteristics of the known disposable electrodes are concerned, these are the same as those of the metal electrodes. However, it has been found that the form and surface characteristics of the known electrodes leave something to be desired as regards the collecting power of the electrodes, that is, the ability of the electrodes to attract and retain charged particles.

SUMMARY OF THE INVENTION

It is, accordingly, a general object of the invention to provide improvements in devices of the type wherein charged particles are attracted to and deposited on one or more electrodes.

More particularly, it is an object of the invention to provide improvements in electrofilters or electrostatic precipitators.

Still more specifically, it is an object of the invention to provide improvements in the electrodes used in devices of the type under discussion.

Another object of the invention is to provide a collector electrode which has an enhanced ability to attract and retain charged particles as compared to the collector electrodes used heretofore.

A further object of the invention is to provide a collector electrode having an enhanced ability to attract and retain charged particles and which is simple and inexpensive to manufacture and is disposable.

In accordance with these objects and others which will become apparent, the invention provides, in an electrostatic precipitator, at least two electrodes one of which is a collector electrode towards which charged particles are attracted. The collector electrode is provided with a plurality of projections so as to enhance the ability thereof to attract and retain the charged particles.

The electrostatic precipitator or electrofilter may be of the type utilizing a plurality of collector electrodes and a passage for the flow of a gas such as air may be defined in the precipitator. Each of the collector electrodes may be provided with a profile according to the invention, that is, the outer surfaces of the collector electrodes which face the air passage may each comprise a plurality of projections and depressions. The projections and depressions may be of three-dimensional configuration. The collector electrodes may comprise a dried, cast or molded fiber material which is either provided with an electrically conductive coating or is impregnated with an electrically conductive substance.

As will become clearer from the following discussion, the separation or precipitation effect, that is, the segregation of certain components such as, for example, impurities, from the gas passing through the precipitator, is greatly improved by the use of a profile or configuration according to the invention. Under otherwise identical conditions, the use of electrodes in accordance with the invention results in a reduction in size of the precipitator. The departure from the heretofore smooth and, hence, easily cleaned, surfaces, is of little consequence since the collector electrodes according to the invention may be of disposable type rather than of the type which need be cleaned.

Where the collector electrodes are made of a dried, cast fiber material, it becomes a simple matter to impart to these both a corase profile and a fine profile, that is, to provide the collector electrodes with both longer and shorter projections. In fact, collector electrodes made of a cast fiber material frequently inherently possess a fine profile due to the nature of the cast fiber material. Moreover, cast fiber material is an extremely cheap material as is known from actual practice in the manufacture of egg cartons and egg pallets. As far as imparting electrical conductivity to the material of the collector electrodes is concerned, impregnation with graphite has been found to be particularly suitable for this purpose.

According to one embodiment of the invention, the exposed surfaces of the collector electrodes, that is, those surfaces thereof towards which charged particles are attracted, may have imparted thereto a roughened texture by providing the electrodes with a fine profile or, in other words, by providing the electrodes with short projections. Advantageously, the projections and the corresponding depressions of the fine profile will have a height or length of at least 0.1 millimeters and, still more advantageously, this height or length will be in excess of 0.2 millimeters. As a result of the roughened surface texture, impurity particles which have been drawn into the vicinity of a collector electrode will be held not only by electrical forces but also by mechanical forces. The segregation effect is thus correspondingly improved.

In accordance with another embodiment of the invention, the exposed surfaces of the collector electrodes exhibit a coarse profile, that is, the collector electrodes are provided with long projections. In this embodiment, the projections and depressions have a height or length which exceeds the thickness of the material of which the electrodes are made. In particular, where two electrodes are arranged adjacent one another, the height or length of the projections and depressions should be equal to at least 20 percent of the mean or average distance between the electrodes and, advantageously, this height or length will be equal to between 40 and 70 percent of this distance. Due to this coarse profile, the gas travelling through the passage in the precipitator will be subjected to deflections, turbulence and the like. Consequently, the impurity particles being conveyed along with the gas will intermittently be urged closer to the collector electrodes whereby the probability of immediate segregation of the impurity particles as a result of the electrostatic field is increased. In addition, field strength concentrations are generated at the tips or ends of the projections which likewise improve the segregation effect. Furthermore, the coarse profiles increase the surface area of the collector electrodes and this may also serve to improve the segregation effect. In accordance with the invention, the collector electrodes may simultaneously exhibit a fine and a coarse profile, that is, the exposed surfaces of the collector electrodes may be provided with both shorter and longer projections.

It is particularly favorable when the collector electrodes have the form of egg pallets wherein a plurality of rows of projections are arranged side-by-side and a depression is defined intermediate four neighboring ones of the projections. Such egg pallets are not only very inexpensive to come by because of the fact that they are produced in extraordinarily great quantities for other purposes but also possess coarse and fine profiles which are very usable for the collector electrodes according to the invention.

The collector electrodes in accordance with the invention may, in particular, be arranged adjacent one another in substantial parallelism and in such a manner that the projections of the coarse profile of one electrode are each located opposite a depression of the coarse profile of a neighboring electrode. In such an arrangement, the projections of the coarse profile of one electrode may extend inwardly of the opposite depression of the coarse profile of a neighboring electrode, that is, the projections and depressions of the coarse profiles of neighboring electrodes may overlap. Thus, when a gas such as air is passed between the collector electrodes in a direction substantially parallel thereto, the gas is subjected to deflections and turbulence sufficiently frequently to achieve the desired high segregation effect.

According to a preferred embodiment of the invention, the collector electrodes are arranged transversely of the gas passage or shaft of the precipitator, that is, the electrodes are arranged one after the other in the passage and transversely to the direction in which the gas is conveyed into the passage. In this embodiment, the collector electrodes are provided with a plurality of openings so as to permit the gas to pass therethrough. The openings in adjacent electrodes are offset relative to one another or, in other words, the openings in adjacent electrodes do not lie on a line with one another. Advantageously, the openings are provided at the tips or ends of the projections and depressions. By the use of such an arrangement, the direction of flow of the gas in the passage must be partially reversed which leads to good segregation results.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view illustrating one configuration for a collector electrode according to the invention;

FIG. 2 is a partial section through the electrode of FIG. 1;

FIG. 3 is a schematic representation in longitudinal section of an electrostatic precipitator provided with collector electrodes in accordance with FIG. 1; and FIG. 4 is a schematic partial longitudinal section of an electrostatic precipitator provided with a modified form of collector electrodes according to the invention.

DESCRIPTION OF THE PREFERRED EMBODIMENTS:

Referring now to FIG. 1, a collector electrode in accordance with the invention is indicated generally at 1. The electrode 1 is here shown as having the form of an egg pallet or egg carton although, for the sake of clarity, only a portion of the electrode 1 is illustrated as having this configuration. In the illustrated embodiment, the electrode 1 is assumed to be composed of a molded or cast fiber material which is impregnated with graphite, the purpose of the latter being to impart electrical conductivity to the material of the electrode 1. The electrode 1 could, however, be provided with an electrically conductive coating instead of being impregnated with graphite. The electrode 1 has an outer or exposed surface 2 which, in accordance with the invention, exhibits a fine profile and a coarse profile, that is, when viewed from the side, the electrode 1 is seen to be provided with shorter and longer projections, respectively.

FIG. 2 shows more clearly the fine profile of the electrode 1 which is seen to be made up of short or small projections 3. The projections 3 impart to the surface 2 of the electrode 1 a roughened texture. Of course, although reference is made here to projections, it will be appreciated that the fine profile of the electrode 1 also includes small or shallow depressions. The height or length of the projections 3 is indicated by the distance *a* which represents the distance between the tip or end of a projection 3 and the deepest adjacent location of the surface 2. In this exemplary embodiment, the projections 3 are assumed to have a height of 0.2 millimeters. However, the projections 3 may have a lesser height than this although the height of the projections 3 will advantageously be at least 0.1 millimeters.

With reference again to FIGS. 1 and 2, the coarse profile of the electrode 1 is seen to be made up of projections 4 and depressions 5 which extend from a median or planar portion 6 of the electrode 1. In the illustrated embodiment, some of the projections 4 extend from the median portion 6 in one direction whereas others of the projections 4 extend from the median portion 6 in an opposite direction, the projections 4 being hollow and each defining an associated depression 5. The arrangement in the exemplary illustration presented here is such that the projections 4 are arranged in rows and that a depression 5 is defined or located intermediate four neighboring ones of the projections 4. Of course, it may be seen that the reverse is also true, namely, that a projection 4 is defined or located intermediate four neighboring ones of the depressions 5.

As may be seen in FIG. 2, the thickness of the material of the electrode 1 is represented by *d*. The height or length of the projections 4 and, correspondingly, the height or depth of the depressions 5, is indicated by *h* which represents the distance between the surface of the median portion 6 and the tip or end of a projection 4. The height of the projections 4 and the depressions 5 exceeds the thickness of the material of the electrode 1 and, advantageously, the height of the projections 4 and the depressions 5 amounts to between 5 and 20 times the thickness of the material of the electrode 1.

Coming now to FIG. 3, it will be seen that an electrostatic precipitator is schematically represented here. The precipitator includes a wall or housing 7 which defines and encloses a gas passage or shaft 8. A blower 9 is provided and is effective for forcing a gas such as air which is to be purified or, more generally, from which certain components are to be separated, through the passage 8 in the general direction indicated by the arrows, namely, in longitudinal direction of the precipitator. An ionization device 10 is also provided and is capable of ionizing impurity particles which are conveyed into the passage 8 along with the gas stream. The portion of the precipitator in which segregation of the impurity particles actually occurs is defined by a plurality of the collector electrodes 1 according to FIG. 1. It may be seen that the electrodes 1 are arranged in substantial parallelism with one another and that the electrodes 1 also extend substantially parallel to the longitudinal direction of the passage 8. Every other electrode 1 is connected to a line 11 and the remaining electrodes 1 are connected to a line 12. The lines 11 and 12, in turn, are respectively connected to the positive and negative terminals of a non-illustrated high-voltage source.

A channel or path 13 is defined intermediate each pair of neighboring electrodes 1. The channels 13 have a width *b* which represents the spacing between the median portions 6 of adjacent electrodes 1. In the arrangement shown here, the width of the channels 13 is chosen in such a manner that the height of the projections 4 and the depressions 5 corresponds to about 50 percent of the width of the channels 13. In general, it is favorable when the height of the projections 4 and the depressions 5 equals at least 20 percent of the width of the channels 13 and it is particularly advantageous when the height of the projections 4 and the depressions 5 amounts to between 40 and 70 percent of the width of the channels 13. Moreover, it will be seen that in the arrangement shown the projections 4 of the respective electrodes 1 are located opposite the depressions 5 of a neighboring electrode 1, the projections 4 here being considered as those portions of the respective electrodes 1 which project into the channels 13. This arrangement has the result that the gas flowing through the channels 13 follows an undulatory or tortuous path *P* which is indicated by the dash-dot line in FIG. 3.

FIG. 4 is a partial longitudinal section through an electrostatic precipitator including a wall or housing 14 which defines a gas passage or shaft 15. The arrangement is generally similar to that shown in FIG. 3 except that here the precipitator is provided with collector electrodes 16 which extend transversely of the general direction of flow of the gas shown by the arrows, that is, transversely of the longitudinal direction of the precipitator. It may be seen that the electrodes 16 are again arranged with the projections 4 of the respective electrodes 16 being located opposite the depressions 5 in the adjacent electrode 16 and, in fact, the projections 4 and depressions 5 of adjacent electrodes 16 are here shown as overlapping although this is not a requirement of the invention. The electrodes 16 of FIG. 4 differ from the electrodes 1 of FIG. 1 solely in that they are provided with openings so as to permit passage therethrough of the gas flowing through the shaft 15. The lower electrode 16 (the term "lower" being used here with reference to the showing in the drawing and not to imply that the precipitator is or need be vertically oriented) is provided with openings 17 and 18 at the tips or ends of the projections 4 and depressions 5, respectively. Although it is advantageous for the openings 17 and 18 to be provided at the tips of the projections 4 and the depressions 5 as shown, this is not a requirement of the invention, the primary consideration being that the openings 17 and 18 in adjacent ones of the electrodes 16 be laterally offset relative to one another. With this arrangement, each opening 17 and 18 will be located opposite an imperforate portion of the respectively adjacent electrode 16. Consequently, the flow path Q of the gas through the passage 15 is that indicated by the dash-dot line in FIG. 4, namely, one wherein the gas changes its flow direction by almost 180° after passing through an opening 17 or 18.

The collector electrodes according to the invention may be made, for example, by pouring a fiber mix or paste into or onto an appropriate mold and subsequently drying the electrode in a suitable drying apparatus. Impregnation with an electrically conductive substance may be carried out afterwards.

The dried cast fiber material may contain fibers of wood, cellulose, used waste paper or the like and a binder which is handled as known in the art e.g. in producing egg pallets, diaphragms for loud-speakers etc.

The electrically conductive coating on the collector electrode may comprise a conductive paint or laquer, a layer of metal particles etc. If the electrode is impregnated the electrically conductive substance may be graphite, some kinds of electrically conductive salts etc.

The thickness of the electrode material is preferably on the order of 1 mm. In an example the first projections have a height of 20 – 25 mm, measured from a median plane, and the second projections have a height of 0,1 – 0,2 mm, measured from the surface of the first projections.

It will be understood that each of the elements described above, or two or more together, may also find a useful application in other types of construction and uses, differing from the types described above.

While the invention has been illustrated and described as embodied in an electrostatic precipitator and electrodes for the same, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended:

1. An arrangement for electrofiltration, comprising a flow passage for a fluid; a voltage source which includes a positive and a negative terminal; and at least two electrodes for generating a potential difference in said flow passage so as to permit charged particles in a fluid flowing through said passage to be separated from the remainder of the fluid, said electrodes being connected to different ones of said terminals, and at least one of said electrodes being a collector electrode which communicates with said passage and attracts charged particles, said collector electrode being provided with a plurality of hollow projections so as to enhance the ability thereof to attract and retain charged particles, and said projection having an end and including a substantially circumferentially complete wall portion which at least in part defines said projection and an associated depression which is outwardly open at a location opposite said end.

2. An arrangement as defined in claim 1, said collector electrode being arranged in a downstream portion of said passage; and wherein ionization means is provided upstream of said collector electrode for ionizing particles in a fluid flowing through said passage.

3. An arrangement as defined in claim 2, wherein said collector electrode comprises a dried, cast fibrous material.

4. An arrangement as defined in claim 1, wherein an electrically conductive coating is provided on said collector electrode.

5. An arrangement as defined in claim 1, wherein an electrically conductive substance is impregnated is said collector electrode.

6. An arrangement as defined in claim 1, at least some of said projections being arranged in a plurality of rows; and wherein four adjacent ones of said some projections surround a depression.

7. An arrangement as defined in claim 1, wherein said projections comprise first projections extending in a first direction, and second projections extending in an opposite second direction.

8. An arrangement as defined in claim 1, said collector electrode being made of material having approximately a predetermined thickness, and said collector electrode having a median surface portion; and wherein the length of said projections as measured from said surface portion exceeds said predetermined thickness.

9. An arrangement as defined in claim 1, said collector electrode having an exposed surface towards which charged particles are attracted, and each of said projections having at least a predetermined first length; and further comprising a plurality of other projections provided on said exposed surface and each having a length less than said first length, said other projections imparting a roughened texture to said exposed surface.

10. An arrangement as defined in claim 9, wherein said other projections have a length of at least 0.1 millimeters.

11. An arrangement as defined in claim 10, wherein said length of said other projections is in excess of about 0.2 millimeters.

12. An arrangement as defined in claim 1 comprising another collector electrode similar to said one collector electrode, said collector electrodes being arranged in substantial parallelism with one another and such that projections of each of said collector electrodes are located substantially opposite depressions in the respective other collector electrode.

13. An arrangement as defined in claim 12, wherein at least some projections of each of said collector electrodes extend inwardly of the corresponding depressions in the respective other collector electrode.

14. An arrangement as defined in claim 12, said collector electrodes being arranged in said passage so as to extend transversely of the direction of flow of fluid through said passage; and wherein each of said collector electrodes is provided with a plurality of openings for passage therethrough of the fluid, the openings in said one collector electrode being offset relative to the openings in said other collector electrode to thereby provide a tortuous path for the fluid.

15. An arrangement as defined in claim 1; further comprising another collector electrode similar to said one collector electrode; and wherein said collector electrodes are spaced from one another by a predetermined distance as measured between median surface portions of the respective collector electrodes, said projections having a length which equals at least about 20 percent of said predetermined distance.

16. An arrangement as defined in claim 15, wherein said length equals substantially 40–70 percent of said predetermined distance.

17. An arrangement as defined in claim 14, said projections each having an end; and wherein said openings are provided in said ends.

18. An arrangement for electrofiltration, comprising a flow passage for a gas; ionization means in an upstream portion of said passage for ionizing particles in a gas flowing through said passage; a voltage source which includes a positive and a negative terminal; and at least two collector electrodes for attracting charged particles arranged in a downstream portion of said passage, said electrodes being connected to different ones of said terminals and being arranged in substantial parallelism with one another, and each of said electrodes being provided with a plurality of discrete cup-like projections having ends and at least in part defining associated depressions which are outwardly open at locations opposite the respective ends, said electrodes being spaced from one another by a predetermined average distance, and said projections having lengths equal to a minimum of about 20 percent of said distance, said electrodes being arranged so that each of said cup-like projections faces and is located substantially opposite a depression in the respective other electrode, and said electrodes comprising a dried, cast fibrous material and an electrically conductive substance.

* * * * *